United States Patent [19]

A'Costa

[11] Patent Number: 4,546,564

[45] Date of Patent: Oct. 15, 1985

[54] RIFLED BORE CONSTRUCTION FOR A GUN BARREL

[76] Inventor: Anthony A'Costa, P.O. Box 5806 - 2216 7th Ave., C-301, Pueblo, Colo. 81003

[21] Appl. No.: 516,230

[22] Filed: Aug. 15, 1983

Related U.S. Application Data

[63] Continuation of Ser. No. 372,867, Apr. 28, 1982, abandoned, which is a continuation-in-part of Ser. No. 131,318, Apr. 27, 1982, abandoned.

[51] Int. Cl.[4] ..... F41C 21/08

[52] U.S. Cl. ..... 42/76 R; 42/78

[58] Field of Search ..... 42/75 B, 76 R, 77, 78, 42/79; 285/391

[56] References Cited

U.S. PATENT DOCUMENTS

| | | | |
|---|---|---|---|
| 37,193 | 12/1862 | Alsop | 42/78 |
| 605,734 | 6/1898 | Mason | 42/75 B |
| 618,033 | 1/1899 | Hemming | 42/75 B |
| 1,370,836 | 3/1921 | Nelson | 42/75 B |
| 1,455,661 | 5/1923 | Rhinehart | 42/79 |
| 2,466,203 | 4/1949 | Bristow | 42/79 |
| 2,736,118 | 2/1956 | Clarkson et al. | 42/75 B |
| 4,297,801 | 11/1981 | Kahn | 42/77 |

*Primary Examiner*—Charles T. Jordan
*Assistant Examiner*—Ted L. Parr
*Attorney, Agent, or Firm*—Edwin E. Greigg

[57] ABSTRACT

The present invention is a further improvement on Marshall et al. U.S. Pat. No. 3,525,172. Herein it is proposed to construct the gun barrel of two sections which are threaded together. The rifled bore of the barrel is terminated at a predetermined point and the smooth bored muzzle portion is threaded into the rifled portion at the juncture point of peak pressure between the two barrel portions. The threaded areas on each of the gun barrel sections are interrupted in a manner that facilitates quick longitudinal assembly and a rotation of the barrels by 90° locks the barrels together.

5 Claims, 8 Drawing Figures

RIFLED BORE CONSTRUCTION FOR A GUN BARREL

This is a continuation of application Ser. No. 372,867, filed Apr. 28, 1982, now abandoned, which is a continuation-in-part of Ser. No. 131,318 filed Apr. 27, 1982, now abandoned.

BACKGROUND OF THE INVENTION

The invention relates to a quick assembly feature for gun barrels of the type disclosed in U.S. Pat. No. 3,525,172 and the improvement thereon which is revealed in application Ser. No. 131,318, filed 4/27/82.

In the early patent, referred to herein there is disclosed and claimed an improved gun barrel the rifling in the bore of which adjoins a cylindrical portion having a constant diameter throughout its length and which extends to the muzzle, the juncture between the rifling and smooth bore portion being predeterminable to attain peak pressure and maximum velocity from the bullet when the fire power of the explosive and caliber of the rifle is known.

The improvement application Ser. No. 131,318, filed 4/27/82 covers the concept of providing a threaded releasable connection between the rifled portion of the smooth bore portion which is claimed in U.S. Pat. No. 3,525,172.

The advantage of providing a releasable connection between the smooth bore portion and the rifled bore portion of the gun barrel is such that when the rifled portion becomes worn, it may be replaced without replacing the smooth bore portion.

As revealed in the earlier application, it is also proposed herein to use the same smooth bore portion with comparable sizes of the rifled portion within a given caliber range.

OBJECTS AND SUMMARY OF THE INVENTION

The primary object of this invention is to provide an interrupted threaded portion in the mating end portions of a gun barrel so that the several portions can be inserted one into the other and then given a sharp quick turn in a direction in opposition to the rifling in the other section to lock the threads in the gun barrels together preparatory to use.

Another object of this invention is to provide indicia on the opposed end surfaces of the several gun barrel portions to enable the user to assemble the mating barrel portions in complete darkness strictly by feeling the indicia and to then know when the barrel portions are securely locked together.

Yet another object of this invention is to provide threaded areas on the opposed end portions of the barrel one being provided on the inside of one of the barrel portions and the other on the exterior of the other barrel portion, thereby providing complementally formed male and female threaded areas.

The invention will be better understood and further objects and advantages thereof will become more apparent from the ensuing detailed description of preferred embodiments taken in conjunction with the drawings.

DESCRIPTION OF THE PREFERRED EMBODIMENTS

Figures 1, 2, 3, 4, 5, 6, 7, 8:
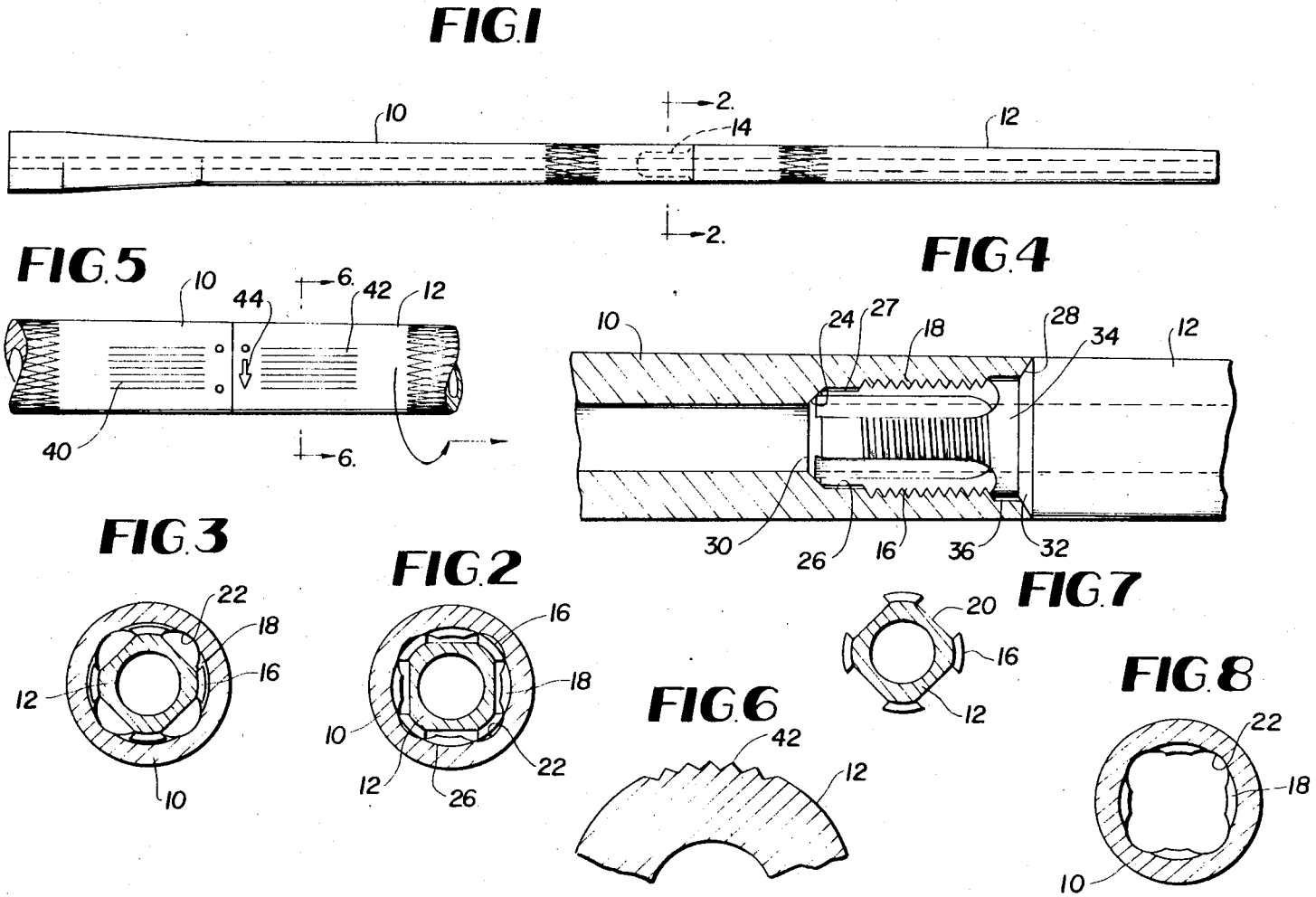
FIG. 1 is an elevational view of the assembled sections of the gun barrel.
FIG. 2 is a sectional view on line 2—2 of FIG. 1.
FIG. 3 is a cross-sectional view showing the several barrel portions in interfitted relation prior to twisting to locked assembly.
FIG. 4 is a schematic view showing the female portion of the gun barrel in cross section and the male portion in elevation.
FIG. 5 shows a fragmentary elevational view of the abutted sections of the gun barrels with the indicia applied thereto.
FIG. 6 shows a fragmentay cross-sectional view of the indicia on the gun barrel.
FIG. 7 is a cross-sectional view looking at the end of the female section of the gun barrel.
FIG. 8 is a cross-sectional view looking at the end of the male section of the gun barrel.

Turning now to the view in FIG. 1, there is shown a two part gun barrel at 10 and 12 which is threadedly secured together at 14. As disclosed in the patent and application Ser. No. 131,318, filed 4/27/82 which were referred to earlier herein the section 10 of the gun barrel is provided interiorly with rifling normally found in barrels of guns. The rifling may, when applied to the interior of the gun barrel have a system of spiral grooves which extend longitudinally of the gun barrel either in a left or right hand direction. The direction of the spiral grooves is not important to this invention since the concept will function with the rifling extending in either direction.

Further reference is made at this time to U.S. Pat. No. 3,525,172 and the drawings and specification thereof. Line 24 of the graph in FIG. 1 of the patent indicates the bore resistance created by frictional drag on the lands of the rifling by a projectile discharged in an ordinary rifle. The resistance in tons per square inch is read on the scale 25. The resistance in an ordinary barrel reaches a maximum of approximately 20 tons per square inch at line 26—26 or 10.75 inches from the breech of the barrel and decreases to slightly less than 15 tons per square inch at the muzzle. The solid lines imposed on the graph indicate the performance of an ordinary rifle in which the diameter of the bore is uniform from breech to muzzle and the broken lines indicate the performance of a rifle embodying the invention illustrated in FIG. 2 and using the same type of ammunition.

One of the purposes of that invention was to provide a gun barrel, the inside diameter of which is increased at a predetermined point and such enlargement continues uniformly from this point to the muzzle. Accordingly, the rifle barrel shown in FIG. 2 of that patent has a uniformly enlarged portion 18 of constant diameter which is bored from the muzzle thereof to the point of peak pressure as indicated by the line 26'—26'.

In FIG. 2 there is shown a cross-sectional view on line 2—2 of FIG. 1 in which the threaded portions of the two gun barrels have been inserted one into the other, this view showing the structure at the time of assembly, and after rotation of the threaded areas to bring about the locking operation.

The threading operation of each of the gun barrel portions is performed in the usual manner as is well-known to those skilled in the art. First, each gun barrel section is appropriately threaded so that the portions of the gun barrels are brought into abutment as shown in FIG. 2. After each section is threaded the portion of the gun barrel bearing the threades is introduced to a milling machine and portions of the threads are removed longitudinally thus leaving smooth areas 20 on the male portions of the barrel and smooth areas 22 on the female portion of the barrel.

In addition to threading each section of the gun barrel and thereafter milling particular portions of each section of the gun barrel 10 and 12 to remove opposed areas of the threads the several sections of gun barrel are reamed as will now be explained.

As noted in the patent referred to herein and the application Ser. No. 131,318, filed 4/27/82 gun barrels are subjected to high pressures and must be capable of maintaining at least 50,000 psi and as great as 60,000 psi on the projectile as it is ejected from the gun muzzle. Also, of importance is the use in a gun covered by this concept of the invention of fast and slow burning powders. By a fast burning powder is meant those powders commonly known as:

XM777 Lake City Arsenal, Ball Powder, Winchester Corporation

Blue Dot Shot Gun Powder, Ball Powder, Hercules Corporation

Unique Powder—Ball Powder—Hercules Corporation

#760—Ball Powder—Winchester Corporation

#748—Ball Powder—Winchester Corporation

Some examples of slow burning powders that have been tested in the gun covered by this application are: H.P.C. (Hercules Powder Corporation) No. 12, Lot No. 3 and No. 30. Lot No. 1 and also Dupont Corporations' propellants #4320, #4895, #4350 and #4064.

Although it has not been explained earlier herein the forward gun barrel portion is provided with a smooth cylindrical portion of constant diameter which extends from the muzzle end of the gun barrel back to the zone of the seat 30 at the terminus of that barrel section. In other words, as revealed in the earlier patent and application Ser. No. 131,318, filed 4/27/82 the muzzle area of the gun barrel has a smooth inner wall and only the rearward section includes rifling The female portion of the gun barrel is reamed to provide a smooth chamfered seat 24 inwardly of the threaded area 18. It will be further noted from the view in FIG. 2 that in close proximity to the threaded area 18 a cylindrical wall 26 is provided and it is this wall which merges into the chamfered area 24. Also, the annular collar 27 on the male threaded member provides a sealing means which cooperates with the inner wall 26.

The extreme end of that portion of the gun barrel 10 is also provided with a smooth annular chamfered area 28, for a purpose that will now be explained.

By referring again to FIG. 2, it will be seen that the muzzle 12, which has been threaded at 16 and then reamed, has also been appropriately provided with a terminal seat portion 30 which sealingly abuts the seat areas of the barrel portion 24 while the annular wall 12 of the muzzle has been smoothly chamfered at 32 to form a seal with the chamfered area on the extremity of the barrel 10. Between the chamfered area 32 and the threaded area 16 on the female member there is disposed an annular collar 34 which forms a seallike fit with the inner annular wall 36 of the muzzle portion. Thus, it will be apparent from the foregoing that this gunnel barrel is designed with no less than four interfitting seals i.e., 24 and 30, 26 and 27, 34 and 36 and 28 and 32 and will thus provide as efficient a gunnel barrel as would be available if the barrel were made from a single piece of stock.

Relative to the ease in assembling the muzzle section 10 with the gun barrel 12 reference is made to the views in FIGS. 5 and 6. Adjacent to the end of barrel portion 10 the exterior surface thereof is provided with a knurled area 40 which functions as part of a first indicia means. The gun barrel 12 in a zone in relative close proximity to the end thereof is also provided with knurling 42 for a purpose that will be apparent. As stated earlier herein, it is contemplated to be able to assemble the several sections of the gun barrel in complete darkness. With the indicia applied to the adjacent ends of the gun barrel portions it can be readily understood how the assembly thereof is achieved merely by feel. Also, in FIG. 5 the arrow is to indicate to the user of the gun which direction to turn the section 12 relative to the other section in order to lock the several sections together for firing. The arrow 44 is shown in the drawing as pointing downwardly thus the barrel 12 is rotated in a clockwise direction for assembly with the section 10 and with this design the rifling in the muzzel section 10 will be arranged to extend the length thereof in the opposite direction so that there is no tendency for the bullet to effect the threaded connection. Adjacent to the arrow 44 on the gun barrel 12 are colored marking dots which also assist with proper assembly of the several barrel sections. These colored dots must be placed in opposition to the colored dots provided near the end of the muzzle and the portion of the barrel and when they are in proper alignment it will be apparent that the several sections of the gun barrel are ready for firing.

A one-piece gun barrel is normally provided with a smooth exterior surface, however, it is contemplated with this design that the surface of the muzzle and barrel will be provided with a roughened area for grasping and relative rotation of the several sections.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An improved two piece gun barrel including first and second gun barrel portions joined together to form one continuous gun barrel having a breech end and a muzzle end, said first and second gun barrel portions having a constant outer diameter extending from their joined terminus ends, said first gun barrel portion having a rifled bore portion of a given constant inside diameter extending from a point adjacent said breech end thereof terminating in a female end at a desired point from said breech end, said rifled portion including spiral lands and grooves of a constant diameter which extend longitudinally of said first gun barrel portion with the spiral in a desired direction, said female end of said first gun barrel portion including screw threads along a portion thereof, a first cylindrical portion inwardly of said threaded portion having a diameter which is less than said threaded portion and a chamfered sealing surface extending from said first cylindrical portion to said rifled portion of said first gun barrel portion, a second cylindrical portion that extends from said threaded portion toward a terminus of said first gun barrel portion, and a smooth chamfer area that extends from said second cylindrical portion to the outer cylindrical surface at the terminus of said first gun barrel, said second gun barrel portion having a smooth cylindrical bore of constant diameter extending from said muzzle end thereof terminating in a male end, said smooth cylindrical bore of said second gun barrel portion having a diameter not less than the diameter of said lands in said first gun barrel portion, said male end of said second gun barrel portion having an outer threaded portion, a third cylindrical portion outwardly of said threaded portion and a fourth cylindrical portion inwardly of said threaded portion, the diameter of said third cylindrical portion mating with said first cylindrical portion of said first gun barrel portion, said threaded portion of said male portion mates with said threaded portion of said female end of said first gun barrel portion and said fourth cylindrical portion mates with said second cylindrical portion of said female end of said first gun barrel portion, said male end of said second gun barrel portion includes an end that seals with said inner chamfer of said female end of said first gun barrel portion, and said second gun barrel portion includes a chamfer inwardly of said threaded portion that mates with said chamfer on the terminal end of said female end of said first gun barrel portion to form a seal, said threaded portions of said male and female ends of said first and second gun barrel portions having equally longitudinal sections of said threaded portions removed along the entire threaded portions with the depth of said removed longitudinal sections being greater than a depth of said threads on said threaded portions to form longitudinally interrupted threads whereby said male end of said second gun barrel portion can be inserted into said female end of said first gun barrel portion such that said threaded portions remaining subsequent to removal of said longitudinal sections will slide along said removed longitudinal sections of each respective gun barrel portion until the chamfered ends of each respective gun barrel portions contact each other and said second gun barrel portion is rotated in a direction opposite to the direction of the spiral of said grooves in said first gun barrel portion thereby securing said second gun barrel to said first gun barrel portion with said chamfered surfaces forming tight seals.

2. A gun barrel according to claim 1, wherein the first and second gun barrel portions are provided with a knurling applied to an exterior surface in close proximity to a juncture zone of said portions.

3. A gun barrel according to claim 2, wherein said knurling is spaced from said juncture zone of said gun barrel portions and a secondary indicia means is interposed between said knurling on each said gun barrel portion.

4. A gun barrel according to claim 2, wherein each said gun barrel portion is provided with a roughened exterior surface outboard of said knurling on each portion.

5. A method of forming a two piece gun barrel including first and second gun barrel portions which can be quickly secured together in a tight fit to form a continuous gun barrel having a breech end and a muzzle end, said first gun barrel portion including lands and grooves which extend from said muzzle along the length of said first gun barrel portion and said second gun barrel portion has a smooth bore in which the smooth bore has the same diameter as the lands of the first gun barrel portion, which comprises cutting a gun barrel into first and second portions with the barrel cut being at a point at which a pressure resulting from release of energy from an explosive charge of a cartridge is at a maximum peak pressure, milling the cut end of said first gun barrel portion to provide a bore coaxial with said lands and grooves therein which said bore has three adjacent sections of different diameter, an innermost section, a middle section, and an outermost section with the innermost section having the least diameter, forming a first chamfer at the inner end of the innermost diameter section of said bore which chamfer extends toward said breech end and which intercepts the lands and grooves, forming a second chamfer which extends from the outer diameter surface of the barrel from the cut end of said first gun barrel portion toward said breech end to intercept with the outermost diameter section, forming threads along the middle diameter section extending from said outermost diameter section to said innermost diameter section with said threads formed with the cut of the threads in a direction opposite to the spiral direction of said lands and grooves, forming a male end on the cut end of said second gun barrel portion in which said male end formed includes different diameter sections, a threaded section and a chamfered surface which are complemental with said formed female end of said first gun barrel, and milling said threaded portions of said male and said female ends longitudinally to form equally spaced longitudinal interruptions having a depth of at least the depth of said threads on said threaded portions to form equally spaced threaded sections which are equal to said longitudinal interruptions, inserting said male end of said second gun barrel portion into said female end of said first gun barrel portion until the chamfered ends are juxstaposed each other, rotating said second gun barrel portion with respect to said first gun barrel portion counter to the spiral direction of said lands and grooves in order to secure said male end of said second gun barrel portion in a locked tight seal within said female end of said first gun barrel portion whereby said first and second gun barrel portions form a continuous gun barrel.

* * * * *